US008152279B2

(12) United States Patent
Sakuma et al.

(10) Patent No.: US 8,152,279 B2
(45) Date of Patent: Apr. 10, 2012

(54) LIQUID EJECTION HEAD HAVING SUBSTRATE WITH NICKEL-CONTAINING LAYER

(75) Inventors: Sadayoshi Sakuma, Yokohama (JP); Hirokazu Komuro, Yokohama (JP); Satoshi Ibe, Yokohama (JP); Takuya Hatsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 359 days.

(21) Appl. No.: 12/485,298

(22) Filed: Jun. 16, 2009

(65) Prior Publication Data

US 2009/0315955 A1 Dec. 24, 2009

(30) Foreign Application Priority Data

Jun. 18, 2008 (JP) ..... 2008-159659
Jun. 18, 2008 (JP) ..... 2008-159660

(51) Int. Cl.
*B41J 2/05* (2006.01)

(52) U.S. Cl. ..... 347/64; 347/63

(58) Field of Classification Search ..... 347/50, 347/56–59, 61–65, 67
See application file for complete search history.

(56) References Cited

U.S. PATENT DOCUMENTS 5,485,185 A 1/1996 Sueoka et al.
5,924,197 A 7/1999 Murakami et al.
6,084,612 A 7/2000 Suzuki et al.
6,910,759 B2 * 6/2005 Kawamura et al. ..... 347/50
6,969,154 B2 11/2005 Takeuchi et al.
7,250,113 B2 7/2007 Komuro et al.
7,591,071 B2 9/2009 Ibe et al.
2006/0033782 A1 2/2006 Sakai et al.
2007/0120902 A1 5/2007 Ozaki et al.
2007/0242106 A1 10/2007 Shibata et al.
2008/0076197 A1 3/2008 Komuro et al.
2008/0094454 A1 4/2008 Koyama et al.
2009/0309933 A1 12/2009 Shibata et al.
2009/0315953 A1 12/2009 Ibe et al.
2009/0315958 A1 12/2009 Hatsui et al.

FOREIGN PATENT DOCUMENTS

EP 1 543 977 6/2005
EP 1543977 * 6/2005
JP 2005-199701 7/2005

* cited by examiner

*Primary Examiner* — Juanita D Jackson
(74) *Attorney, Agent, or Firm* — Fitzpatrick, Cella, Harper & Scinto

(57) ABSTRACT

An ink jet printing head substrate has a high adhesion between an electrode layer and a nozzle formation member and the corrosion or electrolysis, for example, of an electrode due to the contact between the electrode and ink can be reduced. The ink jet printing head includes an electrode layer for supplying power to a heat-generating portion that is provided on a substrate and that generates thermal energy for ejecting ink; and a resin layer provided on the electrode layer via a nickel-containing layer. The electrode layer includes precious metal as a main component. The nickel-containing layer consists of a gold-nickel alloy containing nickel.

11 Claims, 11 Drawing Sheets

| CONCENTRATION OF Ni IN FILM | 100wt% | 4.3wt% | 2.8wt% | 1.4wt% | 0.3wt% | 0.1wt% | 0wt% |
|---|---|---|---|---|---|---|---|
| ADHESION WITH ORGANIC FILM | H | H | H | H | L | L | L |

LIQUID EJECTION HEAD HAVING SUBSTRATE WITH NICKEL-CONTAINING LAYER

BACKGROUND OF THE INVENTION

1. Field of the Invention

The present invention relates to a liquid ejection head for ejecting liquid. In particular, the invention relates to the improvement of the adhesion between an electrode layer for supplying electric power to a heat-generating portion for generating thermal energy for ejecting ink droplets and a resin layer provided on the electrode layer in an ink jet printing head for ejecting ink droplets.

2. Description of the Related Art

In recent years, with the advance of printing techniques, an ink jet printing apparatus also has been required to realize a printing with a higher speed and a higher image quality. In order to satisfy this requirement, it is required to increase the printing width of an ink jet printing head (hereinafter also called as printing head) and to arrange, in a printing head substrate as a component of the printing head, nozzles (also called ejection openings) with a higher density. To realize this, an increased number of heat generation resistance elements have been formed on a printing head substrate with a narrower pitch. This consequently requires an electrode layer for supplying electric power to the heat generation resistance elements to have a lower resistance in order to supply stable and uniform electric power to the respective heat generation resistance elements. Due to this reason, approaches by the formation of an electrode layer made of material having a lower resistance and by an increase of the thickness of an electrode layer on the substrate have been conventionally suggested.

One technique for increasing the thickness of the electrode layer as described above is a printing head substrate disclosed in Japanese Patent Laid-Open No. 2005-199701. This printing head substrate realizes a lower resistance by forming an electrode layer by plating with a gold (Au) having a thick thickness.

Generally, an electrode layer formed on a substrate for an ink jet printing head requires corrosion resistance. Thus, the electrode layer is made of noble metal such as gold (Au) and has thereon an insulating protection film as an upper layer so as to be protected from ink. This protection film may be formed, for example, by a method for forming an inorganic film made of SiN or Si for example by a vacuum film formation technique or the like. However, another method for forming an insulating protection film also has been currently considered by which an organic film made of polyimide or the like or resin such as polyether amide constituting an adhesion-improving layer for forming a nozzle is coated by the spin coating. The following section will describe the reason why organic material is used to form an insulating protection film.

In the ink jet printing head, in a process for forming nozzle components for forming an ink flow path and an ink ejection opening on a substrate, an organic film and a resin layer are layered on the substrate. Thus, if a film of organic material is formed on an electrode layer formed on a substrate, this film can function both as an insulating protection film and a nozzle component. This can consequently simplify the steps manufacturing a printing head and can reduce the material cost.

However, since an electric power wiring made of noble metal material is chemically-stable, this wiring has a poor adhesion to organic material. This causes a reduced adhesion at an interface between a nozzle component made of organic material and the electric power wiring. Furthermore, when an insulating protection film of an electrode layer is made of organic material, the insulating protection film consisting of organic material provided on the surface of the substrate is subjected to ink to expand or receives the stress caused by the heating of the heat generation resistance element and thus is easily peeled from the substrate. Thus, the ink jet printing head having an insulating protection film made of organic material has a disadvantage in that ink passes between the nozzle component and the electrode layer to enter the electrode and this ink causes the electrode to corrode or to be electrolyzed.

SUMMARY OF THE INVENTION

It is an objective of the present invention to provide a liquid ejection head by which a high adhesion can be obtained between an electric power electrode and a nozzle component and the corrosion or electrolysis for example due to the contact of a electrode with ink can be reduced.

In order to achieve the above objective, the present invention has the following configuration.

According to the first embodiment of the present invention, a liquid ejection head having a ejection opening for ejecting liquid, comprising: an element substrate having an element for generating energy used to ejection liquid through the ejection opening; a member having a wall of a liquid flow path communicating with the ejection opening; and a resin layer provided between the element substrate and the member so as to contact the element substrate, wherein the element substrate has a gold-containing electrode layer electrically connected to the element and a nickel-containing layer provided on the electrode layer so as to contact the resin layer on a side of a surface at which the element is provided.

According to the second embodiment of the present invention, a liquid ejection head having a ejection opening for ejecting liquid, comprising: an element substrate having an element for generating energy used to ejection liquid through the ejection opening; and a member having a wall of a liquid flow path communicating with the ejection opening; and wherein the element substrate has a gold-containing electrode layer electrically connected to the element and a nickel-containing layer provided on the electrode layer so as to contact the resin layer on a side of a surface at which the element is provided.

According to the third embodiment of the present invention, a liquid ejection head having a ejection opening for ejecting liquid, comprising: an element substrate having an element for generating energy used to ejection liquid through the ejection opening; and a resin layer provided so as to contact the element substrate, wherein the element substrate has a gold-containing electrode layer electrically connected to the element and a nickel-containing layer provided on the electrode layer so as to contact the resin layer on a side of a surface at which the element is provided.

According to the present invention, in a liquid ejection head comprising a element substrate configured so that a substrate has thereon an electrode layer and a resin layer also function as a protection film of the electrode layer, the adhesion between the electrode layer and the resin layer can be improved. Furthermore, the present invention also can reduce a possibility where an adhesive layer formed between the electrode layer and the resin layer for example may be peeled from the electrode layer. This can consequently reduce the peeling of the resin layer from the substrate and the corrosion of the electrode layer due to the ingression of ink, thus providing a printing head substrate and a printing head having high durability and reliability.

Further features of the present invention will become apparent from the following description of exemplary embodiments (with reference to the attached drawings).

BRIEF DESCRIPTION OF THE DRAWINGS

FIG. 4F is a cross-sectional view schematically illustrating the structure shown in FIG. 4E that has thereon photoresist.

DESCRIPTION OF THE EMBODIMENTS

The following section an embodiment of the present invention with reference to the drawings.

First Embodiment

Figure 1:
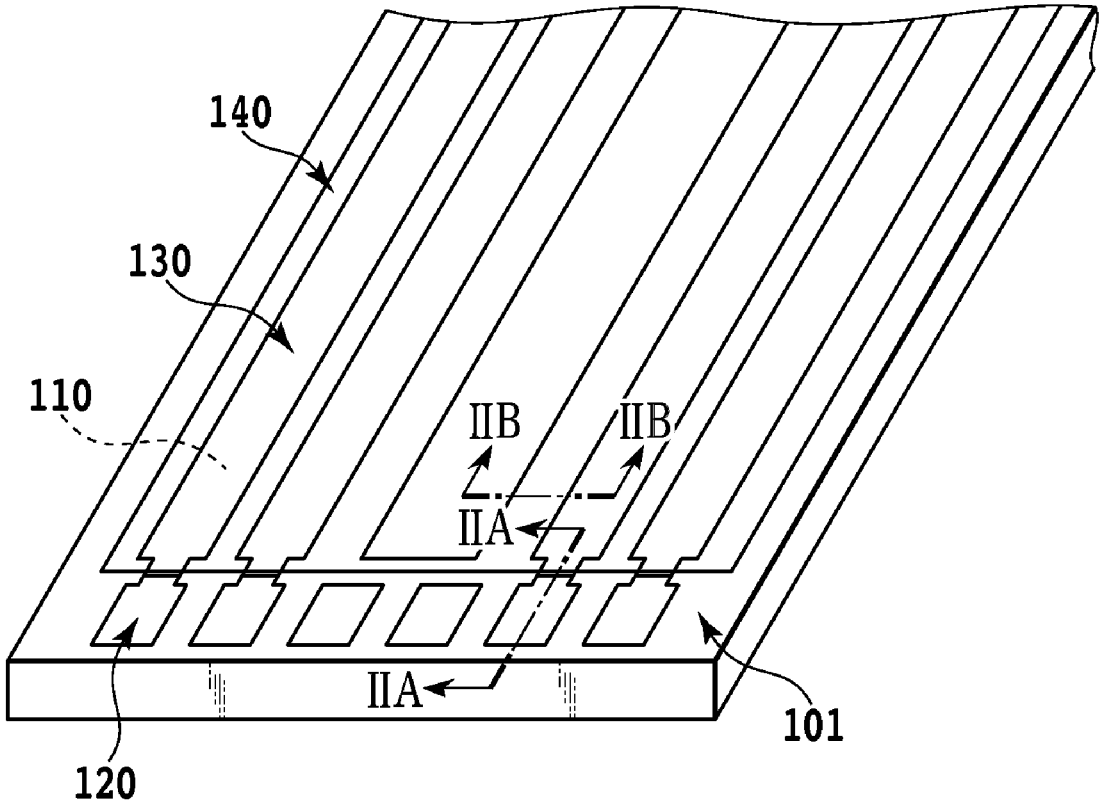
FIG. 1 is a perspective view schematically illustrating an embodiment of an element substrate of a liquid ejection head according to the present invention.

FIG. 1 illustrates the structure of the element substrate of the liquid ejection head to the present invention. In FIG. 1, a silicon substrate 101 has thereon: a power wiring 130 for supplying power to a printing head; a terminal 120 for allowing this power wiring 130 to be conductive with the outer side; and a protection film 140 covering the surface of the power wiring 130 (upper face in FIG. 1). Since the power wiring 130 requires a corrosion resistance to ink, the electrode layer 130 can be made of precious metal such as gold, silver, palladium, platinum, rhodium, or ruthenium. The protection film 140 and the power wiring 130 have therebetween a nickel plating layer 110 that functions as an adhesion layer to allow the power wiring 130 to be adhered to the protection film 140. The nickel plating layer 110 has a lower chemical stability than that of the power wiring. The term "chemical stability" means that the compound does not easily decompose and does not react with other compounds. This adhesion layer (nickel plating layer) 110 is not formed on the terminal 120. Specifically, the adhesion layer 110 is formed only at the surface of the power wiring at a position opposed to the protection film 140 (the lower side of the protection film 140 in FIG. 1). This is for the purpose of favorably maintaining the reliability of the joint between the terminal 120 and a wiring substrate (e.g., flexible print substrate TAB lead) for example. Specifically, when the nickel plating layer 110 is formed on the terminal 120, the terminal 120 is electrically connected to a not-shown electric wiring substrate by a method such as bonding. The existence of the nickel plating layer 110 on the terminal 120 deteriorates the adhesion between the electric wiring substrate and the terminal 120 to thereby damage the reliability of the electric joint. The term "lower layer" herein means a layer closer to a surface of the substrate (the upper face in FIG. 1) than a certain target layer. On the contrary, the term "upper layer" means a layer further away from the surface of the substrate than the target layer.

As described above, in this embodiment, the nickel plating layer 110 is formed only at the surface of the power wiring at the lower layer than the protection film 140. Thus, without damaging the reliability of the electric joint of the terminal 120, the adhesion between the power wiring 130 and an organic layer (which will be described later) can be improved, thus suppressing the peeling of the resin layer. This can consequently reduce the ingress of ink into the power wiring 130 from the outside, thus providing a highly-reliable element substrate of the liquid ejection substrate.

Figure 2A:
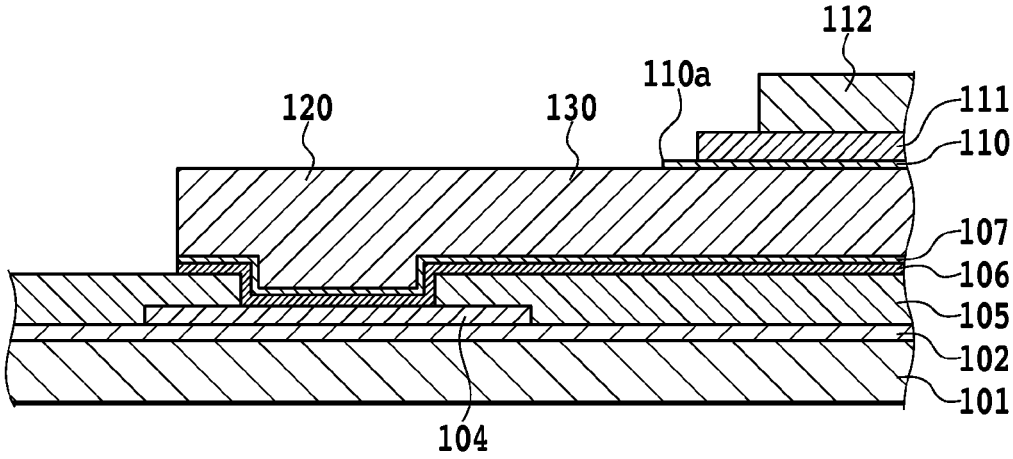
FIG. 2A is a cross-sectional view illustrating the element substrate of a liquid ejection head shown in FIG. 1 taken at the line IIA-IIA.
Figure 2B:
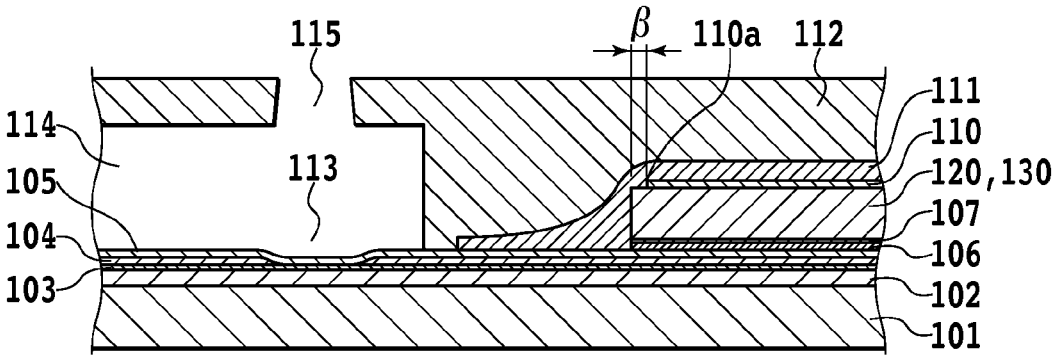
FIG. 2B is a cross-sectional view illustrating the element substrate of a liquid ejection head shown in FIG. 1 taken at the line IIB-IIB.

The following section will describe in more detail the structure of the element substrate of the liquid ejection substrate shown in FIG. 1 with reference to FIG. 2. FIGS. 2A and 2B are cross-sectional views illustrating the element substrate of the liquid ejection substrate shown in FIG. 1. FIG. 2A is a cross-sectional view taken at the line IIA-IIA in FIG. 1 and shows a cross-sectional structure in the vicinity of the terminal. FIG. 2B is a cross-sectional view taken at the line IIB-IIB in FIG. 1 and shows a cross-sectional structure in the vicinity of the nozzle.

In FIG. 2A, the surface of a substrate 101 (the upper face of FIG. 2A) has thereon a heat storage layer 102. The surface of this heat storage layer 102 has thereon an aluminum wiring layer 104. The surface of this aluminum wiring layer 104 has a plating conducting body 107 via a diffusion prevention layer 106. The surface of the plating conducting body 107 has thereon the power wiring 130 and the terminal 120. This power wiring 130 is electrically connected to the plating conducting body 107.

A protection layer 105 is provided between an aluminum wiring 104 and the surface of the heat storage layer 102 and the back face of the diffusion prevention layer 106 (the lower face in FIG. 2A). The upper layer of the power wiring 130 has thereon a resin layer 111 consisting of polyether amide-base resin via an adhesion layer 110. The surface of the resin layer 111 has thereon a nozzle formation member 112 as a flow path formation member forming an ink ejection opening 115 and an ink flow path 114. The nozzle formation member 112 is made of cured epoxy resin. Specific examples of epoxy resin include alicyclic epoxy resin, bisphenol-type epoxy resin, novolac-type epoxy resin, and glycidyl ether-type epoxy resin for example.

As shown in FIG. 2B, the silicon substrate 101 has thereon the heat storage layer 102 consisting of SiO2 and a heat generation resistant material layer 103 for converting electric energy to thermal energy. At the upper layer of the silicon substrate 101, the aluminum wiring layer 104 and the protection film 105 are formed.

In the ink jet printing head substrate having the configuration as described above, power supplied from the outside to the terminal 120 is supplied via the power wiring 130 and the aluminum wiring layer 104 to a heat-generating portion 113 to cause the heat-generating portion 113 to generate heat. This heat causes the ink in the ink flow path to foam to cause a foaming pressure. This foaming pressure causes ink droplets to be ejected through the ejection opening.

Next, a method of manufacturing the element substrate of the liquid ejection head in the first embodiment of the present invention will be described with reference to FIGS. 3A to 3K and FIGS. 4A to 4K.

Figure 3A:
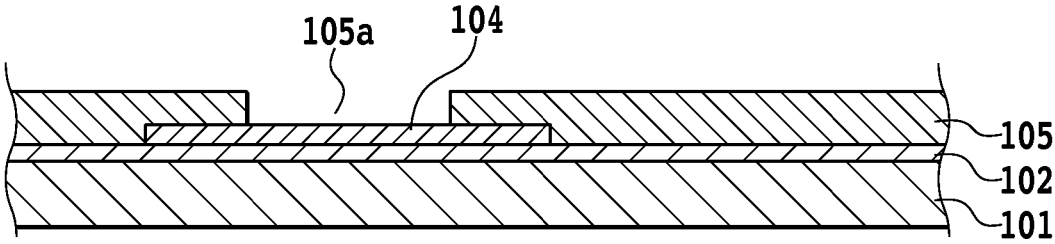
FIG. 3A is a cross-sectional view illustrating the element substrate of a liquid ejection head shown in FIG. 1 taken at the line IIA-IIA and schematically illustrating a method of manufacturing the element substrate of the liquid ejection head shown in FIG. 1 and shows a substrate having thereon a heat storage layer, an aluminum wiring layer, and an insulating protection layer.

FIGS. 3A to 3K are a cross-sectional views taken at the line A-A shown in FIG. 1. FIGS. 4A to 4K are a cross-sectional views in the direction of the line IIB-IIB in the respective steps. Hereinafter, description will be made with reference to FIGS. 3A to 3K and FIGS. 4A to 4K. First, as shown in FIG. 3A, the silicon the substrate 101 has thereon the heat storage layer 102 consisting of SiO2, the heat generation resistant material layer 103 (see FIG. 2B), and the aluminum wiring layer 104 in this order. Thereafter, an SiN film functioning as an insulating protection layer 105 is formed on the surfaces of the heat storage layer 102 and the aluminum wiring layer 104 to have a thickness of about 300 nm by the vacuum film formation for example. Then, techniques such as photolithography and dry etching are used to form, in the insulating layer 105, a through-hole 105*a* for providing an electric conduction between the power wiring 130 and the aluminum wiring 104 (which will be described later). This allows the power supplied from the power wiring 130 to be supplied to the aluminum wiring 104 through the through-hole 105*a*, thus making it possible to generate heat in a portion of the heat-generating portion 113 connected to the aluminum wiring 104 (see FIG. 2B).

Figure 3B:
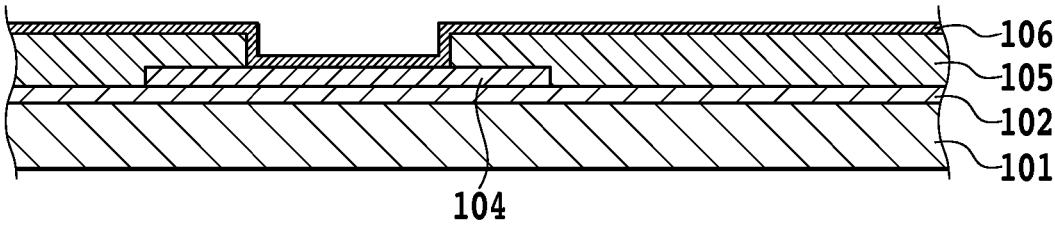
FIG. 3B is a cross-sectional view schematically illustrating the structure shown in FIG. 3A that has thereon a diffusion prevention layer.

Next, as shown in FIG. 3B, the diffusion prevention layer 106 (barrier metal) is formed on the surfaces of the insulating protection layer 105 and the aluminum wiring layer 104 to have a thickness of about 200 nm. This is performed by forming high melting point metal material such as titanium or tungsten for example on the entire surface by the vacuum film formation for example.

Figure 3C:
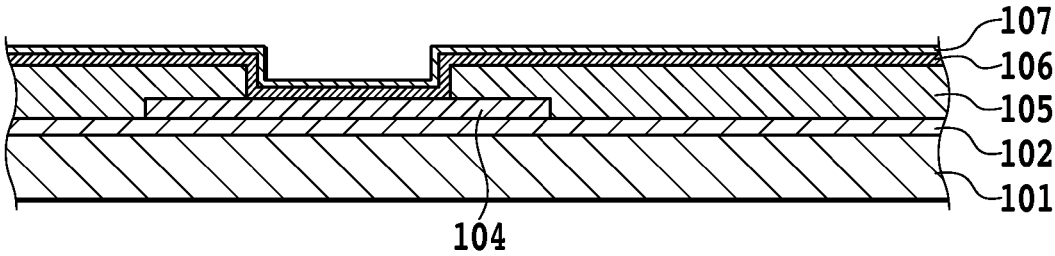
FIG. 3C is a cross-sectional view schematically illustrating the structure shown in FIG. 3B that has thereon a plating conducting body.

Next, as shown in FIG. 3C, the plating conducting body 107 superior as wiring metal is formed to have a thickness of about 50 nm on the entire surface of the diffusion prevention layer 106 by the vacuum film formation for example. In this embodiment, gold (Au) was used as conductive metal. During this formation, it is desired that, in order to improve the adhesion between the diffusion prevention layer 106 and the plating conducting body 107, an inverse sputtering for example is performed to remove the oxide film formed on the surface of the diffusion prevention layer 106.

Figure 3D:
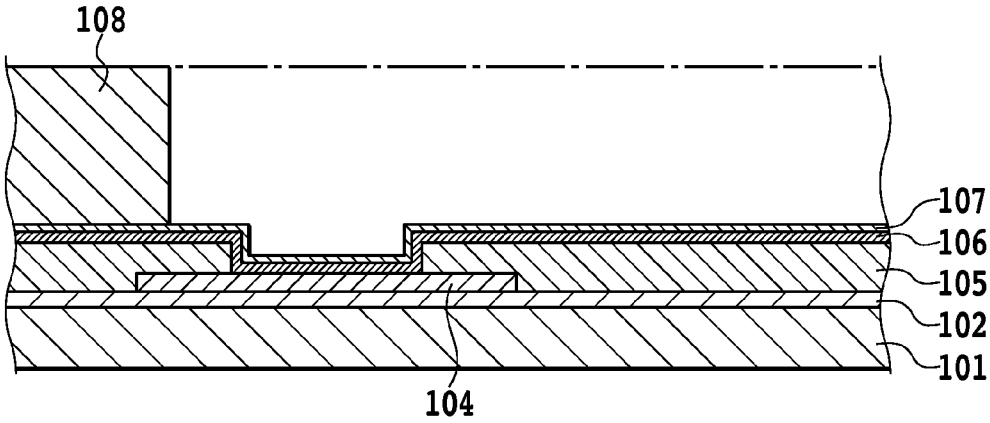
FIG. 3D is a cross-sectional view schematically illustrating the structure shown in FIG. 3C coated with photoresist.

Next, as shown in FIG. 3D, photoresist 108 is formed on the surface of the plating conducting body 107 by the spin coating so that the photoresist 108 has a thickness larger than that of the power wiring 130 to be formed. In this example, the photoresist 108 is coated to have a thickness of about 6 μm that is thicker by 1 μm than the thickness of the gold-plating of about 5 μm used as the power wiring 130.

Next, in order to expose the gold layer of the plating conductive body at a part at which the electrode layer is formed, a part of the photoresist 108 shown by the chain double-dashed line in FIG. 3C is removed. In this removal step, the photolithography is firstly used to perform resist exposure and development to subsequently remove photoresist so as to expose the surface of the plating conducting body 107 at a part at which the electrode layer 130 is to be formed. During this process, the remaining photoresist is formed to have a shape as a mold material (first mold material) of the plating coated in the next step (step shown in FIG. 3D).

Figure 3E:
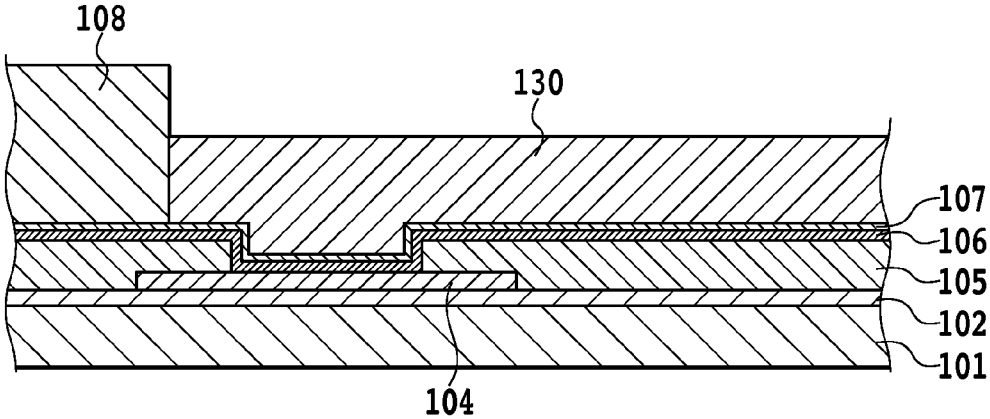
FIG. 3E is a cross-sectional view schematically illustrating the structure shown in FIG. 3D that has thereon an electrode layer.

Next, by the electrolytic plating, in the electrolytic bath of sulfite gold salt, predetermined current is caused to flow in gold as the plating conducting body 107 to precipitate the gold 109 to have a thickness of about 5 μm in a predetermined region not covered by the photoresist 108 (see FIG. 3E).

Figure 3F:
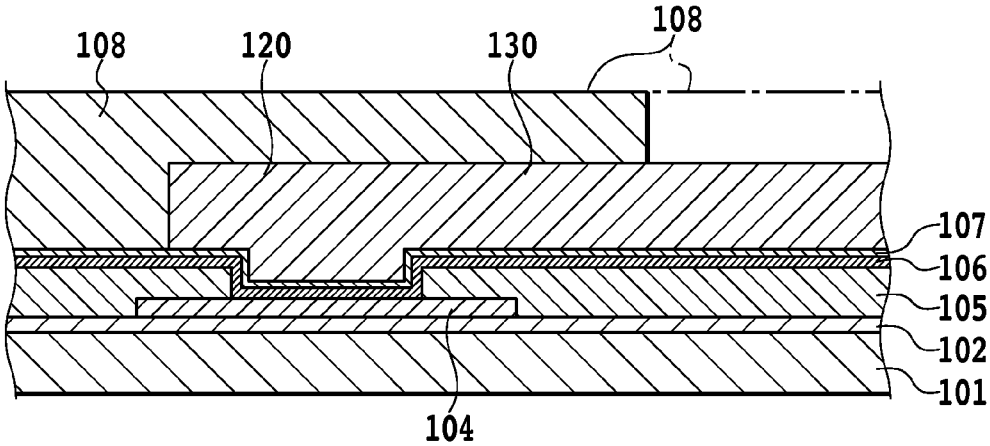
FIG. 3F is a cross-sectional view schematically illustrating the structure shown in FIG. 3E coated with photoresist.

Then, as shown in FIG. 3F, the photoresist 108 is coated again on the surface of the electrode layer 130. This coating is desirably performed so that the photoresist on the electrode layer 130 has a larger thickness than that of an adhesion layer to be formed on the electrode layer 130 in the subsequent step. In this example, to nickel of a thickness of 200 nm as an adhesion layer, photoresist was formed to have a thickness of 2 μm. Thereafter, a part of the coated photoresist 108 shown by the chain double-dashed line in FIG. 3F as the second mold material is removed to expose the gold layer corresponding to a portion at which nickel plating is formed. In this removal step, the photolithography is firstly used to perform resist exposure and development to subsequently remove the photoresist 108 so as to expose the surface of the electrode layer 130 at a portion at which the nickel plating layer 110 as an adhesion layer is to be formed. During this process, the photoresist 108 to be left is formed to have a shape as a mold material of the plating coated in the next step (the second mold material). During this process, the terminal 120 is also covered by the photoresist 108 so that the nickel plating layer 110 as an adhesion layer is not formed. In this first embodiment, the nickel plating layer 110 as an adhesion layer is formed at a region at the inner side of the electrode layer 130. Specifically, as shown in FIG. 1, FIG. 2A, and FIGS. 3A to 3F, an end section 110*a* at the short side of the nickel plating layer (adhesion layer) 110 is positioned at the inner side of an end section 130*a* at the short side of the electrode layer 130. An end section 110*b* at the long side of the nickel plating layer 110 is also positioned, as shown in FIG. 2B, at the inner side of an end section at the long side of the nickel plating layer 110 by a distance β from the end section 130*b* at the long side of the electrode layer 130. This β is set so as to be longer than a distance assumed for the removal of the end section of electrode layer 130 in the subsequent etching step for removing the plating conducting body 107 made of Au. The nickel plating layer 110 desirably has a large area for the purpose of improving the adhesion with the resin layer 111 (see FIG. 2). Thus, the value β is desirably set to be equal to or lower than 5 μm. In this example, the value β is set to 5 μm in consideration of the etching amount of the electrode layer 130. In the case where the plating conducting body 107 is thin and the step of etching the plating conducting body 107 removes a very little amount of the end section of the electrode layer 130, the nickel plating layer 110 also may be provided at the same position as that of the end section of the electrode layer.

Figure 3G:
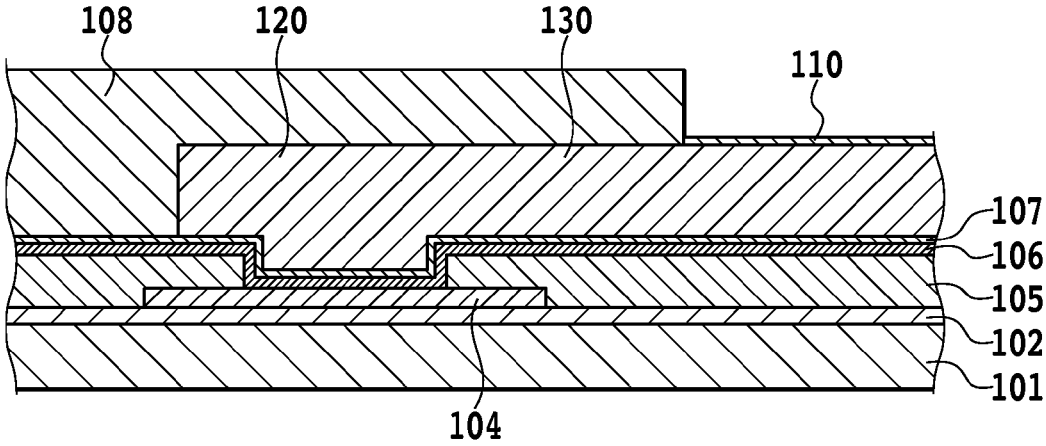
FIG. 3G is a cross-sectional view schematically illustrating the structure shown in FIG. 3F that has thereon an adhesion layer.
Figure 3H:
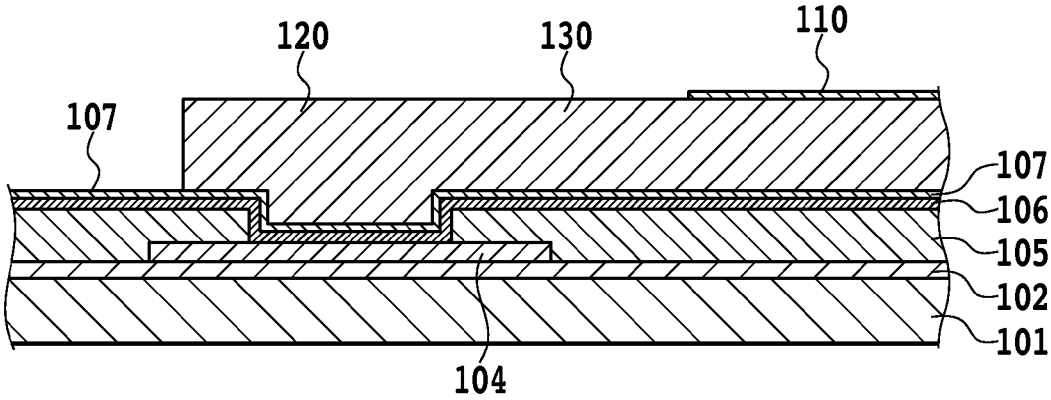
FIG. 3H is a cross-sectional view schematically illustrating the structure shown in FIG. 3G from which the photoresist is removed.

Next, the electrolysis plating is used to cause predetermined current to flow in the electrode layer 130 as a plating conducting body in the electrolysis bath of sulfamic acid to thereby precipitate nickel 110 (Ni) on the surface of the electrode layer 130 as a plating conducting body precipitated in the previous step (see FIG. 3G). Thereafter, the layered structure obtained by layering the nickel 110 shown in FIG. 3F is immersed in the peeling liquid of the photoresist 108 for a predetermined time, thereby removing the photoresist 108. As a result, as shown in FIG. 3H, the plating conducting body gold (Au) layer of the upper layer of the substrate of the diffusion prevention layer 106 is exposed.

Figure 3I:
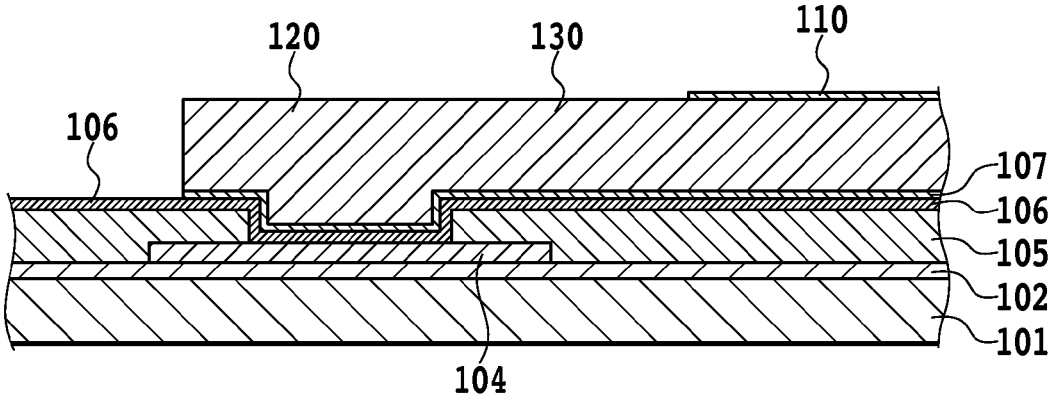
FIG. 3I is a cross-sectional view schematically illustrating the structure shown in FIG. 3H from which the plating conducting body is removed.
Figure 3J:
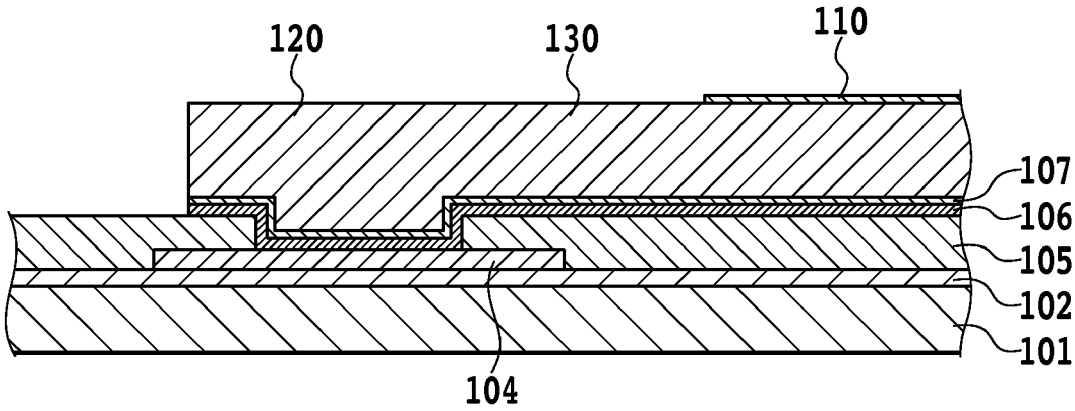
FIG. 3J is a cross-sectional view schematically illustrating the structure shown in FIG. 3I from which the diffusion prevention layer is removed.
Figure 3K:
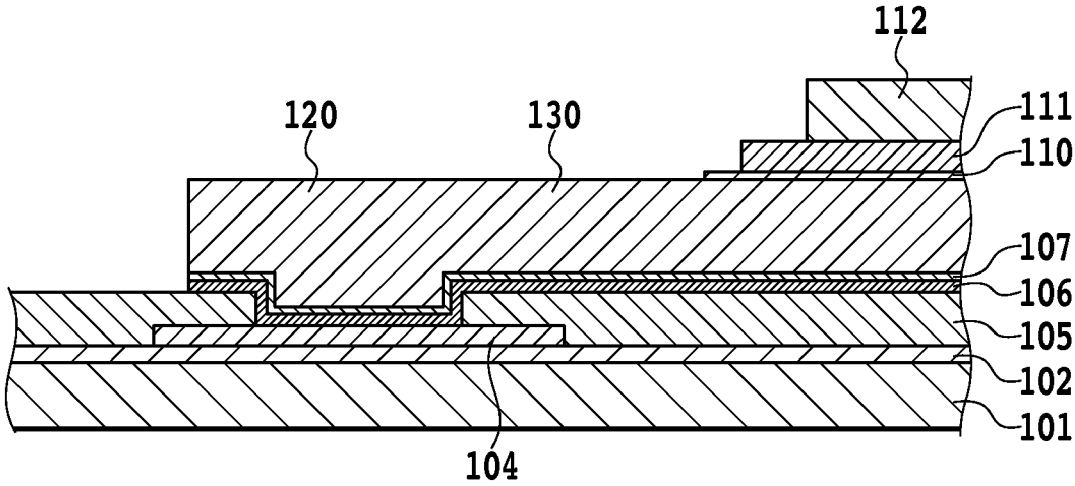
FIG. 3K is a cross-sectional view schematically illustrating the structure shown FIG. 3J that has thereon a resin layer and a nozzle formation member.
Figure 4A:
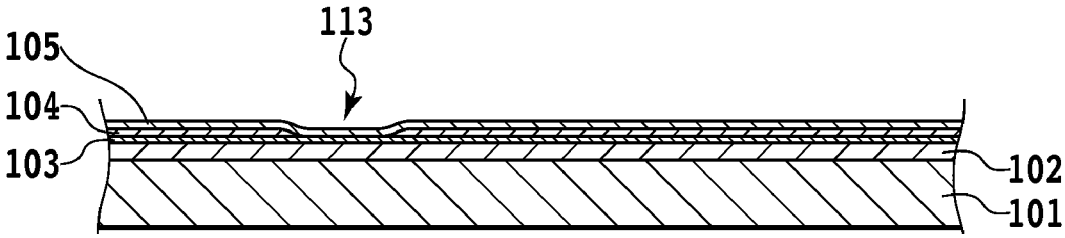
FIG. 4A is a cross-sectional view schematically illustrating a method of manufacturing the ink jet printing head substrate shown in FIG. 1 and taken along the line IIB-IIB and shows the substrate having thereon a heat storage layer, an aluminum wiring layer, and an insulating protection layer.
Figure 4B:
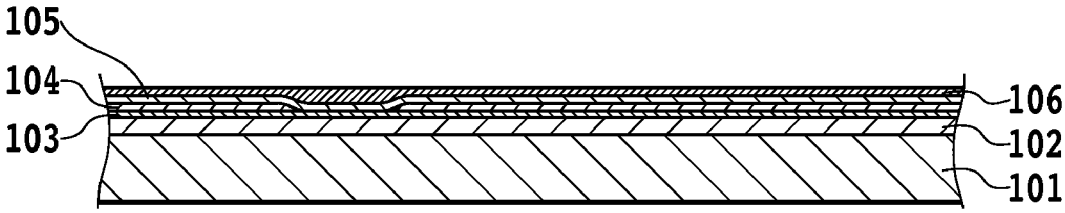
FIG. 4B is a cross-sectional view schematically illustrating the structure shown in FIG. 4A that has thereon a diffusion prevention layer.
Figure 4C:
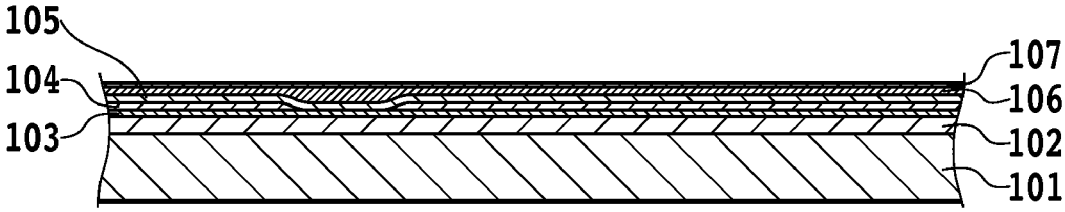
FIG. 4C is a cross-sectional view schematically illustrating the structure shown in FIG. 4B that has thereon a plating conducting body.
Figure 4D:
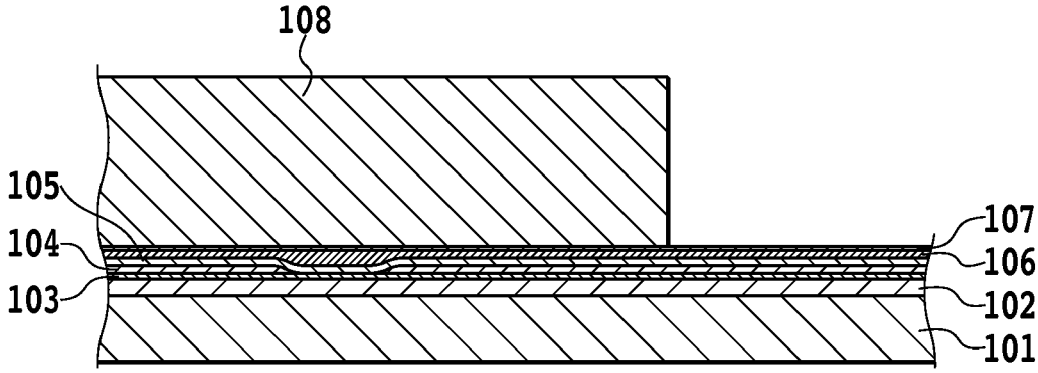
FIG. 4D is a cross-sectional view schematically illustrating the structure shown in FIG. 4C coated with photoresist.
Figure 4E:
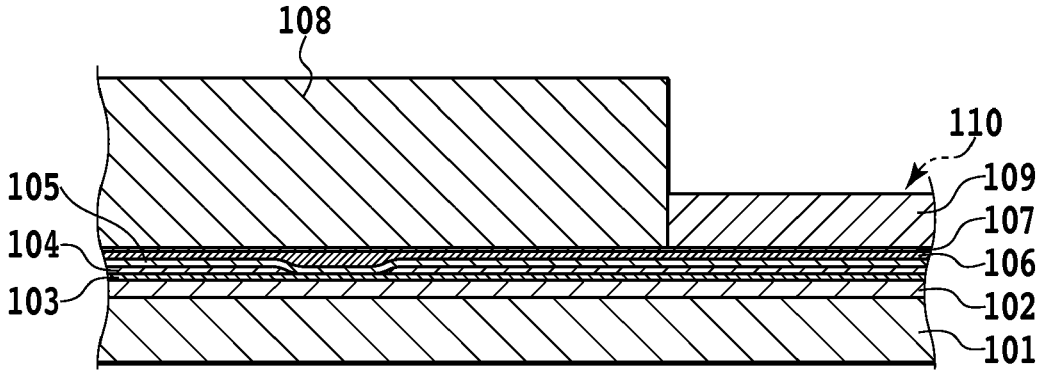
FIG. 4F is a cross-sectional view schematically illustrating the structure shown in FIG. 4D that has thereon an electrode layer.
FIG. 4G is a cross-sectional view schematically illustrating the structure shown in FIG. 4F that has thereon an adhesion layer.
FIG. 4H is a cross-sectional view schematically illustrating the structure shown in FIG. 4G from which the photoresist is removed.
FIG. 4I is a cross-sectional view schematically illustrating the structure shown in FIG. 4H from which the plating conducting body is removed.
FIG. 4J is a cross-sectional view schematically illustrating the structure shown in FIG. 4I from which the diffusion prevention layer is removed.
Figure 4F:
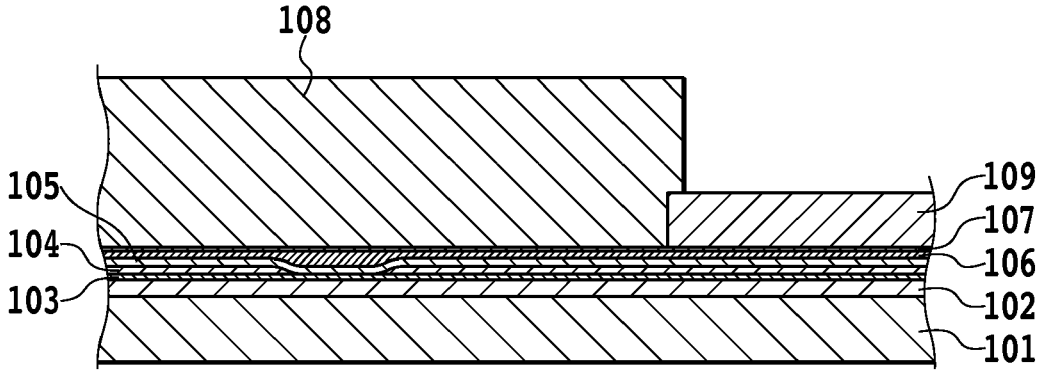
Figure 4G:
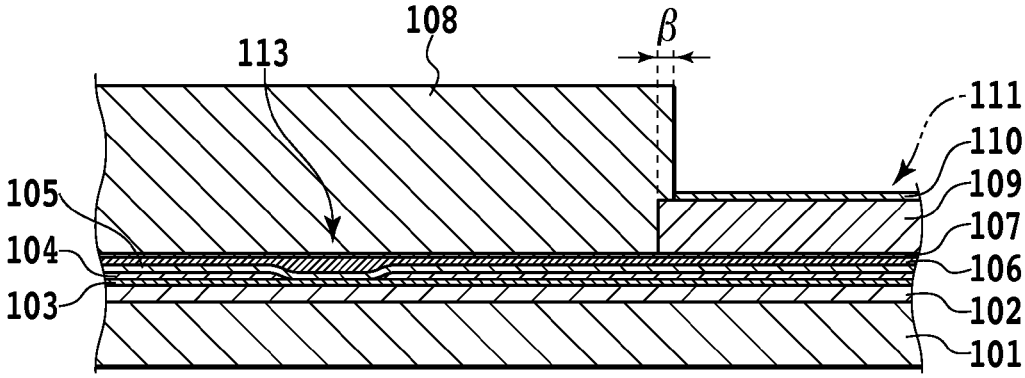
Figure 4H:
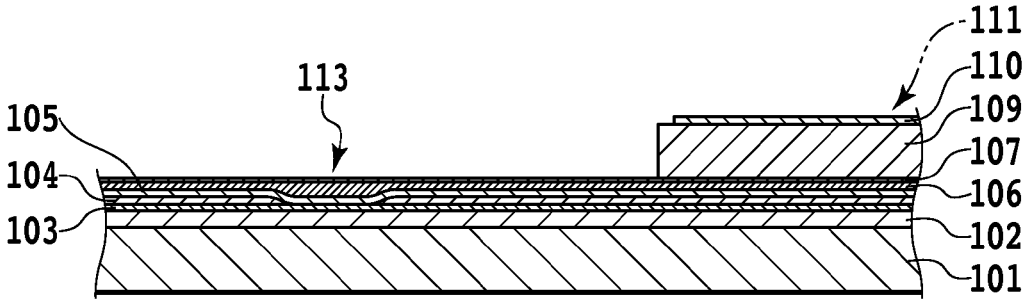
Figure 4I:
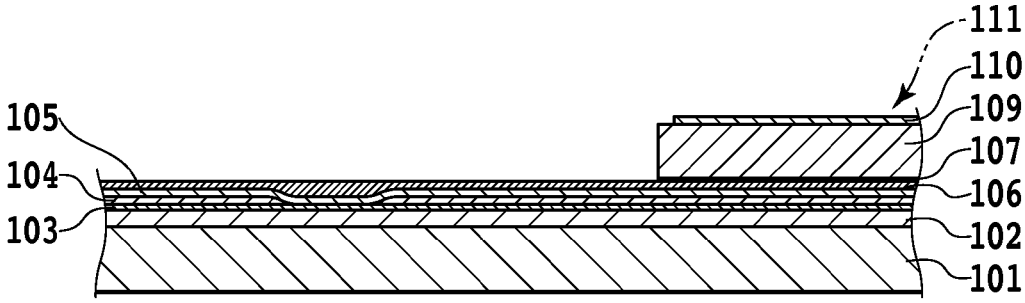
Figure 4J:
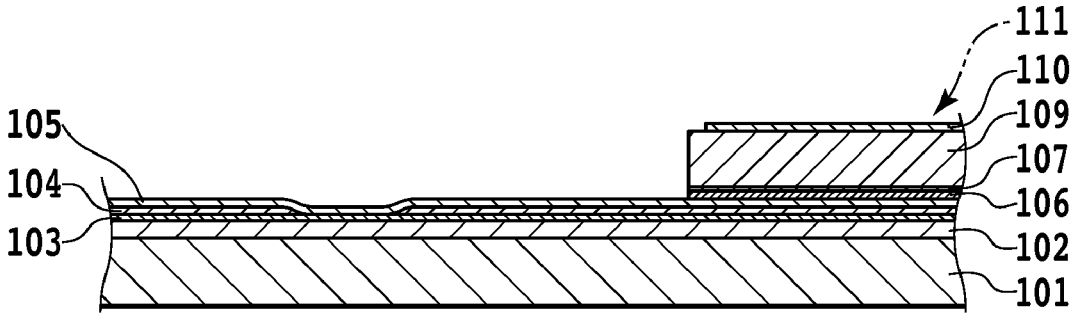

Next, the electrode layer 130 as a mask and the plating conducting body 107 are immersed in the etching liquid including nitrogen-base organic compound, iodine, and potassium iodide to thereby etch and remove the uppermost layer of the electrode layer 130 and the plating conducting body 107 (see FIG. 3I). As a result, the diffusion prevention layer 106 consisting of high melting point metal material such as TiW (barrier metal) is exposed.

Thereafter, the electrode layer 130 as a mask and the diffusion prevention layer 106 consisting of high melting point metal material such as TiW (barrier metal) are immersed in H2O2-base etching liquid for a predetermined time. As a result, the exposed diffusion prevention layer 106 consisting of high melting point metal material is etched and removed (see FIG. 3J).

Next, the resin layer 111 having both of a function of improving the adhesion between the flow path formation layer 112 for forming a nozzle for ejecting ink droplets and an ink flow path and the electrode layer 130 and a function as an insulating film is coated to have an arbitrary thickness by spin-coating. In this process, the resin layer 111 is obtained by coating polyether amide resin for example to provide an arbitrary thickness by spin coating.

Then, the mold material on the resin layer 111 that is to be molded later and that corresponds to an ink flow path is spin-coated with the resin material for forming the flow path formation layer 112 until an arbitrary thickness is reached. Thereafter, photolithography is used to perform exposure and development. As a result, as shown in FIG. 2B, an element substrate of an ink jet printing head including therein a plurality of ejection openings 115 for ejecting ink and the ink flow paths 114 communicating with the ejection openings can be obtained. (see FIG. 3K).

Second Embodiment

Next, the second embodiment of the method of manufacturing the element substrate of the liquid ejection substrate according to the present invention will be described. This second embodiment is the same as the first embodiment to a step of forming a plating gold layer as an electrode layer by electrolysis plating (steps from FIG. 3A to FIG. 3E). The second embodiment is different from the first embodiment in that the step shown in FIG. 3E is followed by steps different from those of the first embodiment as shown below. Specifically, in the first embodiment, as shown in FIG. 3E, the plating gold layer for forming the electrode layer 130 is formed by electrolysis plating to subsequently coat the photoresist 108 as shown in FIG. 3F. On the other hand, in this second embodiment, the step shown in FIG. 3E of forming the electrode layer 130 is followed by a step of entirely removing the remaining photoresist 180 by peeling liquid to subsequently coat the photoresist 108 again (see FIG. 3F). Next, the coated photoresist 108 is subjected to resist exposure and development by photolithography.

Next, electrolysis plating is used to cause predetermined current to flow in the surfaces of the gold layers of the electrode layer 130 and the plating conducting body 107 in an electrolysis bath of sulfamic acid to thereby selectively precipitate nickel (Ni) 110 at the surfaces of the gold layers of the electrode layer 130 and the plating conducting body 107 (see FIG. 3G). Thereafter, the photoresist 108 is immersed in the peeling liquid of photoresist for a predetermined time to thereby remove the photoresist 108, thereby exposing the gold layers of the electrode layer 130 and the plating conducting body 107 (see FIG. 3B). Next, by the same steps as those of the first embodiment, the removal of the plating conducting body 107 (see FIG. 3I) and the removal of the diffusion prevention layer 106 (see FIG. 3J) are performed. Thereafter, as in the first embodiment, polyether amide resin is spin-coated until an arbitrary thickness is reached. Then, material for forming a flow path formation layer is spin-coated to an arbitrary thickness. Photolithography is used to form a plurality of ejection openings for ejecting ink and ink flow paths communicating with the ejection openings (see FIG. 3K). In this manner, the liquid ejection head can be formed.

In this embodiment, the entire removal of the photoresist 108 of the electrode layer 130 by peeling liquid is followed by the second coating of the photoresist 108, thus causing a possibility where a displaced exposure may be caused. Such a displaced exposure may cause a case where the nickel plating layer 110 is provided at a position other than that of the electrode layer 130. When the plating conducting body 107 having a thickness of about 50 nm and the diffusion prevention film 106 having a thickness of about 200 nm are removed by wet etching, the etching is promoted isotropically. Thus, the nickel plating layer 110 is consequently extruded in the lateral direction by a distance of at least about 250 nm. When the nickel plating layer 110 is extruded as described above, a possibility is caused where the formation of a flow path formation layer may damage the nickel plating layer 110.

To prevent this, this example also allows, as shown in FIG. 1, FIG. 2A, and FIGS. 3A to 3K, the end section 110*a* at the short side of the nickel plating layer 110 as the second mold to be positioned at the inner side of the end section 130*a* at the short side of the electrode layer 130 as the first mold. In this example, β is preferably 1 μm or more in consideration of the etching amount of the electrode layer 130 and the alignment accuracy for the exposure of the photoresist 108. In order to secure the adhesion between the resin layer 111 and the nickel plating layer 110, β is preferably 5 μm or less.

Figure 5A:
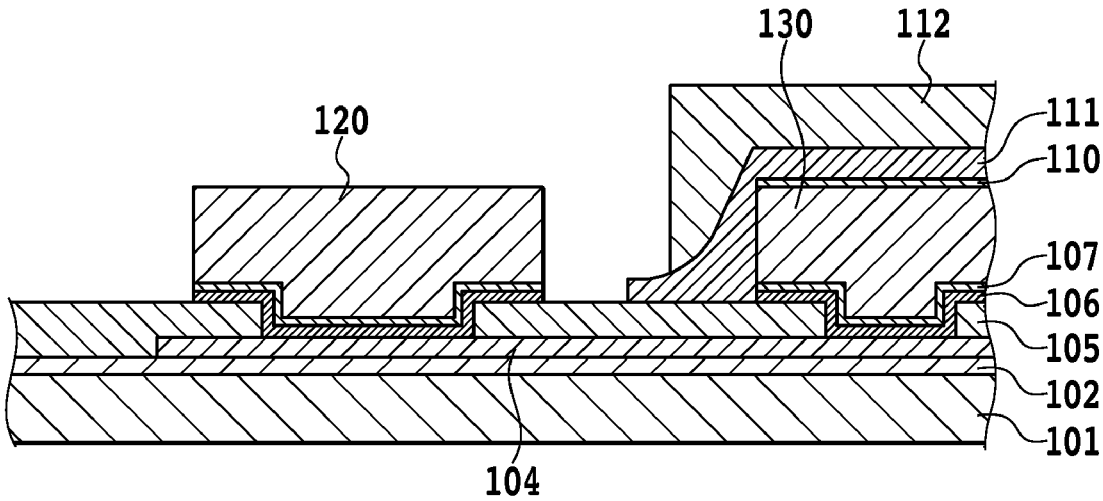
FIG. 5A is a cross-sectional view schematically illustrating the structure of the element substrate of the liquid ejection head of the present invention in another embodiment.

In this embodiment, the electrode layer and the terminal are formed simultaneously and are connected to each other at the surface of the substrate. However, another configuration is also possible as another embodiment where the electrode layer 130 and the terminal 120 are formed independently as shown in FIG. 5 and are electrically connected to each other by different metal layers of the lower layer of the substrate.

Although the electrode layer 130 and the plating conducting body were formed by gold in the above embodiment, the electrode layer 130 and the plating conducting body 107 also may be made of metal other than gold so long as the metal has a superior chemical stability (e.g., the metal having high ionization tendency). Although the adhesion layer 110 formed at the surfaces of the electrode layer 130 and the plating conducting body 107 were formed by base metal such as nickel (Ni) having a lower chemical stability than that of gold, the adhesion layer 110 also may be formed by metal other than nickel. For example, when the electrode layer 130 is formed by gold, then the adhesion layer formed at the surface also can be formed by a gold-nickel alloy layer including nickel.

Figures 5B, 6:
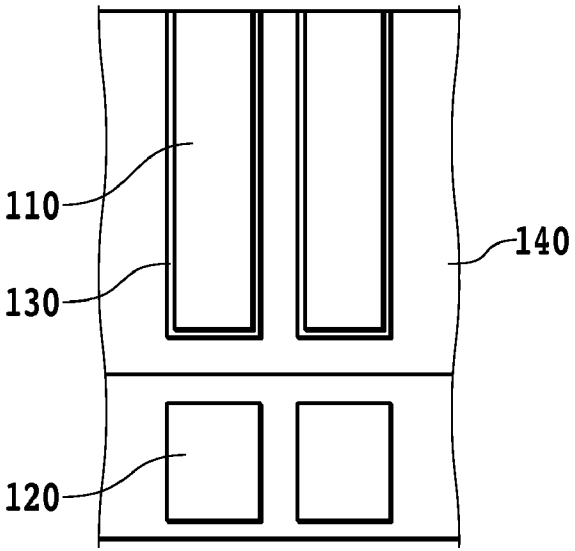
FIG. 5B is a top view schematically illustrating the structure of the element substrate of the liquid ejection head of the present invention in another embodiment.
FIG. 6 is a table illustrating the adhesion of a gold-nickel alloy film and a resin layer when the concentration of nickel in the gold-nickel alloy film is changed in an embodiment of the present invention.

FIG. 6 illustrates a relation of the adhesion of a gold-nickel alloy film and a resin layer with the concentration of nickel in the gold-nickel alloy film when the concentration is changed. On the gold-nickel alloy film formed by plating on the silicon substrate, an organic film was formed by spin coating. Then, the sample was baked and was subjected to a cross-cut peeling and was evaluated with regard to the adhesion.

As shown in FIG. 6, when the content rate of nickel included in the gold-nickel alloy constituting the adhesion layer increases, the adhesion between the adhesion layer and the resin layer as an organic film is improved. This is presumably due to that gold having a superior chemical stability includes more basic metal and thus the resultant material is more chemically active to thereby improve the adhesion with the organic film. In this example, when the content rate of nickel included in the gold-nickel alloy was 1.0 wt % or more, then the adhesion between the adhesion layer and the resin layer as an organic film was improved. When the content rate of nickel included in the gold-nickel alloy was 1.4 wt % or more, then the adhesion between the adhesion layer and the resin layer was favorable and thus the adhesion could be secured even when the sample received the stress caused by the heating of a heat generation resistance element. When the nickel content rate was 0.3 wt % or less, the adhesion between the adhesion layer and the resin layer could not be obtained. In FIG. 6, H shows a high adhesion and L shows a low adhesion, respectively.

As described above, by allowing the gold-nickel alloy constituting the adhesion layer to include nickel at a content rate equal to or higher than a certain threshold value, the adhesion between the electrode layer and the resin layer for protecting the electrode layer can be improved, thus suppressing the resin layer from being peeled. Also according to the present invention, a possibility also can be reduced where the adhesion layer formed between the electrode layer and the resin layer for example is peeled from the electrode layer for example. Thus, an element substrate of the liquid ejection head and a liquid ejection head using the element substrate can have a significantly-improved reliability. Even if the material forming the adhesion layer is made 100% of nickel, the adhesion between an electrode layer and a resin layer for protecting the electrode layer can be improved. However, the adhesion layer is preferably made of gold-nickel alloy because this provides an advantage that the adhesion layer made of gold-nickel alloy has superior corrosion resistance and conductivity of the adhesion layer for example relative to those of the adhesion layer made of nickel only.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-159659, filed Jun. 18, 2008, and 2008-159660, filed Jun. 18, 2008 which are hereby incorporated by reference herein in their entirety.

What is claimed is:

1. A liquid ejection head having an ejection opening for ejecting liquid, comprising:

an element substrate having an element for generating energy used to eject liquid through the ejection opening;

a member having a wall of a liquid flow path communicating with the ejection opening; and a resin layer provided between the element substrate and the member so as to contact the element substrate and the member, wherein the element substrate has a gold-containing electrode layer electrically connected to the element and a nickel-containing layer provided on the electrode layer so as to contact the resin layer on a side of a surface at which the element is provided.

2. The liquid ejection head according to claim 1, wherein the nickel-containing layer is made of nickel or gold-nickel alloy.

3. The liquid ejection head according to claim 1, wherein the nickel-containing layer includes nickel at a rate of 1.4 wt % or more to a weight of the nickel-containing layer.

4. The liquid ejection head according to claim 1, wherein the nickel-containing layer is provided at an inner side of an end section of the electrode layer.

5. The liquid ejection head according to claim 1, wherein the nickel-containing layer is provided at an inner side of an end section of the electrode layer by a distance of 1 μm or more and 5 μm or less.

6. The liquid ejection head according to claim 1, wherein the resin layer and the nickel-containing layer have therebetween an adhesion-improving layer.

7. The liquid ejection head according to claim 6, wherein the resin layer consists of polyether amide resin.

8. A liquid ejection head having an ejection opening for ejecting liquid, comprising:

an element substrate having an element for generating energy used to eject liquid through the ejection opening; and a member having a wall of a liquid flow path communicating with the ejection opening, wherein the element substrate has a gold-containing electrode layer electrically connected to the element and a nickel-containing layer provided on the electrode layer so as to contact the member on a side of a surface at which the element is provided.

9. The liquid ejection head according to claim 8, wherein the member consists of cured epoxy resin.

10. A liquid ejection head having an ejection opening for ejecting liquid, comprising:

an element substrate having an element for generating energy used to eject liquid through the ejection opening; and a resin layer provided so as to contact the element substrate, wherein the element substrate has a gold-containing electrode layer electrically connected to the element and a nickel-containing layer provided on the electrode layer so as to contact the resin layer on a side of a surface at which the element is provided.

11. The liquid ejection head according to claim 10, wherein the resin layer consists of polyether amide resin.

* * * * *